United States Patent [19]

Cha

[11] 4,005,752

[45] Feb. 1, 1977

[54] METHOD OF IGNITING IN SITU OIL SHALE RETORT WITH FUEL RICH FLUE GAS

[75] Inventor: Chang Yul Cha, La Verne, Calif.

[73] Assignee: Occidental Petroleum Corporation, Los Angeles, Calif.

[22] Filed: Oct. 16, 1975

[21] Appl. No.: 622,653

Related U.S. Application Data

[63] Continuation of Ser. No. 492,253, July 26, 1974, abandoned.

[52] U.S. Cl. ..... 166/260; 166/261; 299/2

[51] Int. Cl.[2] ..... E21B 43/24

[58] Field of Search ..... 166/256, 258, 259, 260, 166/261; 299/2–6; 48/197 R, 197 FM

[56] References Cited

UNITED STATES PATENTS

| | | | |
|---|---|---|---|
| 1,919,636 | 7/1933 | Karrick | 299/2 |
| 2,481,051 | 9/1949 | Uren | 299/2 |
| 3,044,545 | 7/1962 | Tooke | 166/260 |
| 3,454,958 | 7/1969 | Parker | 166/256 |
| 3,460,620 | 8/1969 | Parker | 166/247 UX |
| 3,499,489 | 3/1970 | Parker | 166/258 |
| 3,548,938 | 12/1970 | Parker | 166/256 |
| 3,586,377 | 6/1971 | Ellington | 299/4 |
| 3,596,993 | 8/1971 | Busey | 166/257 X |
| 3,675,715 | 7/1972 | Speller, Jr. | 166/256 |

*Primary Examiner*—Stephen J. Novosad
*Attorney, Agent, or Firm*—Christie, Parker & Hale

[57] ABSTRACT

A technique is provided for igniting one in situ oil shale retort with flue gas from an earlier retort. Towards the end of oil shale retorting the flue gas from an in situ retort has a substantial fuel value so that it can be burned for generating heat. This fuel gas is conveyed to the entrance to a second retort and burned to initiate retorting. Even after retorting of the bed of particles in the first retort is completed, a fuel rich flue gas can be obtained and used for ignition of a subsequent retort. In either case the prior retort has a large bed of hot spent oil shale particles through which air is passed to burn carbonaceous material therein. Hot flue gas from the earlier retort can also be used for preheating.

13 Claims, 1 Drawing Figure

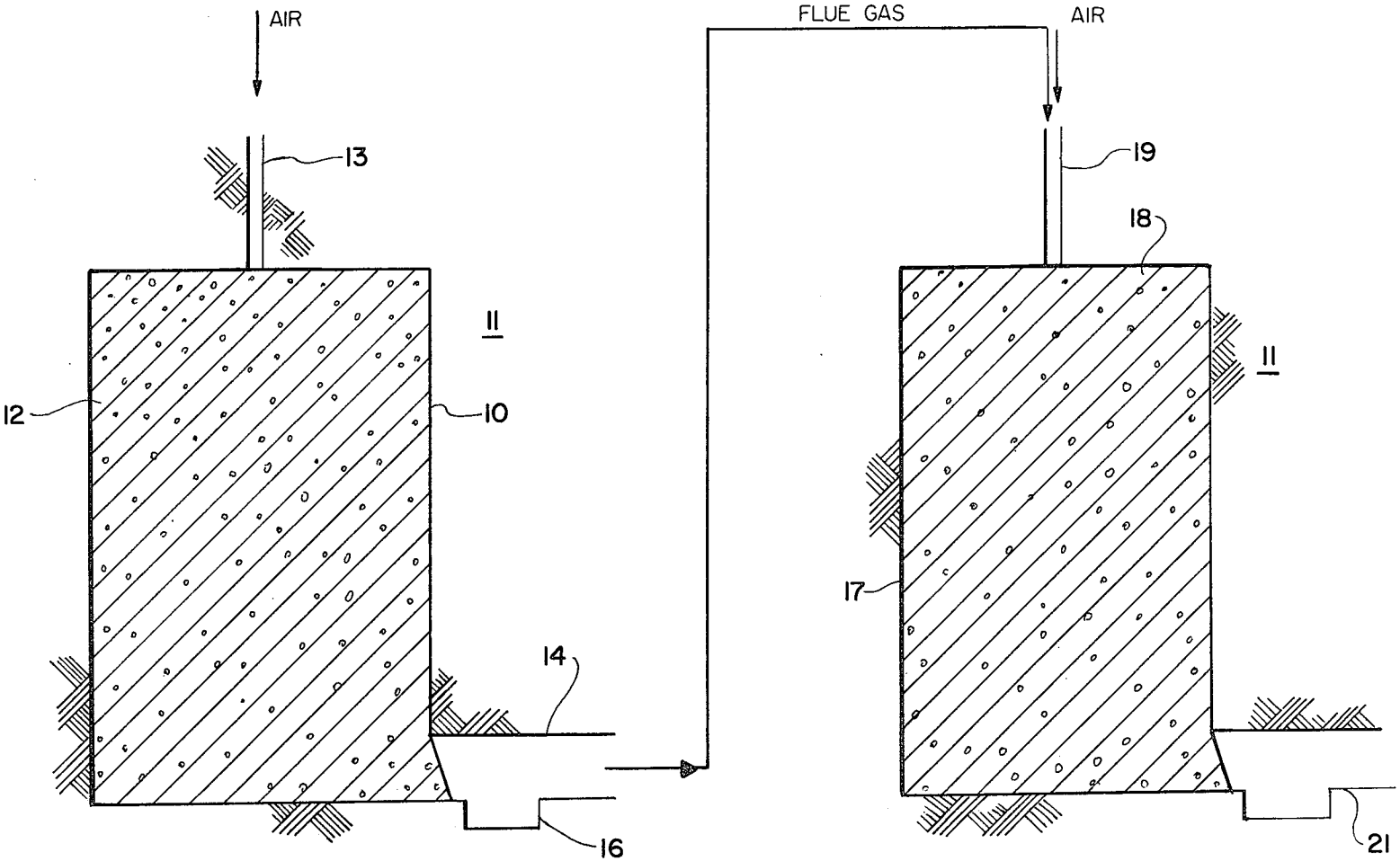
AIR
FLUE GAS
AIR
11
11
10
12
13
14
16
17
18
19
21

METHOD OF IGNITING IN SITU OIL SHALE RETORT WITH FUEL RICH FLUE GAS

CROSS-REFERENCE TO RELATED APPLICATIONS

This is a continuation of application Ser. No. 492,253, filed July 26, 1974, now abandoned.

BACKGROUND

There are vast deposits of oil shale throughout the world with some of the richest deposits being in the western United States in Colorado, Utah and Wyoming. These reserves are regarded as one of the largest untapped energy reserves available. The oil shale is in the form of solid rock with a solid carbonaceous material known as kerogen intimately distributed therethrough. The kerogen can be decomposed to a synthetic crude petroleum by subjecting it to elevated temperatures, in the order of 900° F. This causes the kerogen to decompose to a hydrocarbon liquid, small amounts of hydrocarbon gas and some residual carbon that remains in the spent shale. The heat for retorting the shale oil can be obtained by burning some of the carbonaceous material in the shale with air or other oxidizing gas.

Preferably the oil shale is retorted in situ in a bed of oil shale particles filling a cavity blasted into the undisturbed oil shale. In such an in situ retort the rubble pile of shale particles is ignited preferably at the top and air is passed downwardly through the bed to sustain combustion and retort the oil. Liquid oil flows to the bottom of the retort and is recovered.

Such retorts can be formed, for example, by excavating a portion of rock in a volume that ultimately will become an underground retort. The balance of the rock in the volume to become a retort is then explosively expanded to form a rubble pile or bed of oil shale particles substantially completely filling the retort volume. The original excavated volume is thus distributed through the expanded oil shale particles as the void volume therebetween.

Oil is then extracted from the expanded rubble pile in the underground retort by igniting the top of the bed of oil shale particles and passing an oxygen bearing gas, such as air, downwardly through the retort. Once raised to a sufficient temperature the oil shale will support combustion, initially at the top of the retort by burning some of the oil in the shale. Thereafter, as the oil is extracted there is residual carbon left in the shale, and, when at a sufficient temperature, this too will react with oxygen to burn and supply heat for retorting. This burning of residual carbon in the shale depletes oxygen from the air being passed down through the retort and the substantially inert gas then carries heat to a retorting zone below the reaction zone for decomposing the kerogen and extracting oil. Gases from the bottom of the retort are collected and often contain sufficient hydrogen, carbon monoxide and/or hydrocarbons to be combustible. Oil is also collected at the bottom of the retort and transported for conventional refining.

After retorting of the shale oil is completed, the retort contains a large volume of hot spent shale. This heated spent shale contains a substantial amount of unburned residual carbon. Some combustion does occur in the heated spent shale during retorting by reaction between oxygen and residual carbon. In a typical retorting operation only about 46% of the residual carbon resulting from retorting was consumed during the retorting operation. The other 54% of the residual carbon remained in the spent shale at the end of normal retorting operations. Appreciable quantities of recoverable energy in the form of sensible heat or unburned carbon may remain in the spent shale.

When the oil shale is expanded in the underground retort the particles ordinarily fill the entire volume so that there is no significant void space above the rubble pile. Air for combustion can be brought to the top of the bed of particles by means of holes bored through overlying intact rock. Appreciable difficulty may be encountered, however, in igniting the top of the rubble pile to support combustion. Ignition requires a substantial amount of heat delivered over a sufficient time to raise a reasonable volume of oil shale above its ignition temperature. Some difficulty is encountered in heating a substantial volume of oil shale in the retort and assuring that ignition has been obtained.

BRIEF SUMMARY OF THE INVENTION

There is, therefore, provided in practice of this invention according to a presently preferred embodiment, a technique for igniting an oil shale retort having a bed of unretorted oil shale particles therein by first generating a combustible flue gas in a first retort containing a bed of hot spent oil shale particles. The combustible gas is then burned at the entrance of the retort containing unretorted oil shale for generating an ignition temperature in the bed. The first retort may be entirely spent, with combustible gas generated during post retorting operations, or the combustible gas may be generated near the end of retorting operations in the first retort when there is a large bed of hot spent oil shale, but wherein retorting is still continuing.

DRAWING

These and other features and advantages of the present invention will be appreciated as the same becomes better understood by reference to the following detailed description of a presently preferred embodiment when considered in connection with the accompanying drawing which is a schematic representation of a vertical cross section through a pair of in situ oil shale retorts.

DESCRIPTION

The drawing illustrates a retort for oil shale in the form of a cavity 10 formed in undisturbed shale 11 and filled with a bed or rubble pile of expanded or fragmented oil shale particles 12. The cavity 10 and bed of oil shale particles 12 are ordinarily created simultaneously by blasting by any of a variety of techniques. Such a typical in situ oil shale retort is described and illustrated in U.S. Pat. No. 3,661,423. Several in situ retorts may be in an area and separated from each other by walls of undisturbed shale, known as pillars, which form gas barriers and support the overlying rock.

A conduit 13 communicates with the top of the bed of oil shale particles and during the retorting operation compressed air or other oxidizing gas is forced downwardly therethrough to supply oxygen for combustion. It will be understood that as used herein the term "air" is ordinarily ambient air but can include composition variations including oxygen. Thus, for example, if desired the air can be augmented with additional oxygen so that partial pressure of oxygen is increased. Similarly air can be diluted with recycled flue gas or other materials for reducing the partial pressure of oxygen. Such recycling is, for example, practiced for reducing the oxygen concentration of the gas introduced into the retort to about 14% instead of the usual 20%.

A tunnel 14 is in communication with the bottom of the retort and contains a sump 16 in which liquid oil is collected. Off gas or flue gas is also recovered from the retort by way of the tunnel 14. When the retort is operated the oil shale is ignited adjacent the conduit 13 and the combustion zone so established readily moves downwardly through the retort. At the end of the retorting operation the spent oil shale in the retort is at an elevated temperature with the hottest region being near the bottom, and a somewhat cooler region being at the top due to continual cooling by inlet air during retorting and conduction of heat into adjacent shale. The hot spent shale in the retort contains appreciable amounts of unburned residual carbon present in a relatively reactive form because of its formation from decomposed kerogen.

The drawing illustrates a second oil shale retort in the form of a cavity 17 filled with a bed of oil shale particles 18. As previously described this retort also has a gas conduit 19 at the top and a tunnel 21 at the bottom for recovering products. In practice of this invention the second retort 17 has a bed of unretorted oil shale particles. The bed of oil shale particles 12 in the first retort 10 is made up largely or entirely of spent oil shale from which shale oil has already been retorted.

Towards the end of operation of an in situ oil shale retort the fuel value of the flue gas tends to be higher than at the beginning of retorting. A number of factors may contribute to this effect. One reason, for example, is that as the inlet air passes through a greater thickness of bed containing hot spent oil shale particles more of the oxygen is depleted in the spent shale and there is less combustion of light fractions in the kerogen decomposition products. Also as greater areas of the walls of the retort, which are substantially impervious shale, are heated to elevated temperature there is more retorting of oil from the intervening pillars adjacent the retort. This additional oil may be subjected to appreciably higher temperatures than oil otherwise retorted and therefore be subject to more cracking with consequent light fractions appearing in the flue gas. Each of these effects results in more hydrocarbon gas in the flue gas near the end of the retorting operation and enhanced fuel value. Enhanced amounts of hydrogen and carbon monoxide may also be present in the flue gas when there is a large bed of hot spent shale due to water gas reaction, or reaction of carbon dioxide with carbon to produce carbon monoxide. It is believed that the large amount of fuel rich flue gas near the end of a retorting operation comes about because of the large bed of heated spent oil shale particles which serves to heat the walls of the retort and extract additional hydrocarbon vapors.

After normal retorting operations are completed a continuing flow of air may be provided through the spent retort having a hot bed of spent oil shale particles. Oxygen in the air continues to react with carbonaceous material remaining in the spent shale. The hot shale continues to retort oil from the retort walls and the flow of gases downwardly through the retort sweeps the combustion products, some of which may be flammable, and the hydrocarbon vapors out of the retort as a fue rich flue gas.

The flue gas from the bottom of the retort near the end, and after the end, of retorting operations may be heated to a substantially elevated temperature because of its flow through the hot bed of spent oil shale particles. Temperatures as high as 1000° F. may be reached by the flue gas under some circumstances.

At least a portion of the flue gas from the first retort 10 is conveyed to the top of the second retort 17 containing unretorted oil shale particles. The flue gas from the tunnel 14 is conveyed to the conduit 19 at the top of the second retort through an underground raise (not shown) which typically does not extend to the ground surface so that the length of conduit is minimized. Conventional bulkheads, pipes, valves, blowers if needed, metering devices, and the like will be apparent to one skilled in the art and are not set forth in detail herein.

Air is also introduced through the conduit 19 for combustion with the fuel rich flue gas from the bottom of the first retort. This combustion generates substantial quantities of heat and is continued for a long enough time to heat the top of the bed of unretorted oil shale particles 18 to the ignition temperature. Thus, the fuel rich flue gas obtained near the end of retorting of one retort is used by burning with air or other oxygen containing gas for ignition of a second retort. It is important that the flue gas employed for igniting the second retort be obtained near the end, or after the end, of retorting of the first retort since this gas is richest in fuel value due to the large bed of hot spent oil shale particles through which gas is passed. At this time the bed of hot spent oil shale particles occupies a major portion of the length of the retort. All of the lower portion of the retort may be filled with hot spent oil shale (after the end of retorting) or a minor portion of the length of the bed may be unretorted or retorting oil shale (near the end of retorting).

The flue gas from hot spent shale may be substantially above ambient temperatures when introduced into the second retort and this sensible heat serves to preheat the unretorted oil shale therein and augments the combustion energy. It is generally desirable to employ a flue gas at a temperature below the maximum available from the first retort because of the expense and hazard of conveying hot gas for substantial distances underground. Large volumes of gas are involved and the cost of heat resistant conduits may be prohibitive. Ignition temperatures are therefore obtained by combustion of the fuel rich flue gas instead of merely the sensible heat of the flue gas, although at least a portion of this sensible heat may be of assistance in preheating the unretorted oil shale in the retort to be ignited.

By using the latent heat of the fuel rich flue gas from a spent retort for ignition of a second retort any requirement for external gas sources for ignition can be avoided. Since in situ retorting is done at remote locations any added gas sources required for retorting operations are expensive and preferably avoided.

One can pass hot gas from a first retort having a large bed of spent oil shale particles to the second retort for preheating the unretorted shale therein. Flue gas from the first retort may be burned at the entrance of the second retort so that the latent chemical energy of the fuel therein further preheats and ignites the second retort. Latent heat combined with this latent chemical energy can further augment the preheating and ignition.

Although but limited embodiments of technique for igniting an oil shale retort have been described and illustrated herein many modifications and variations will be apparent to one skilled in the art. Thus, for example, a portion of flue gas from the first retort may be recycled through the retort for further enhancing the fuel value before a portion is used for igniting the second retort. Many other modifications and variations will be apparent and it is therefore to be understood that within the scope of the appended claims the invention may be practiced otherwise than as specifically described.

What is claimed is:

1. A process for igniting an in situ oil shale retort comprising the steps of:

generating a combustible flue gas in a first in situ retort containing a bed of hot spent oil particles by introducing air at the top of the first retort, and withdrawing flue gas from the bottom of the first retort;

burning the combustible flue gas at a top entrance of a second in situ retort containing a bed of unretorted oil shale particles and passing the combustion products downwardly through the bed for heating a portion of the top of the second bed of oil shale particles to the ignition temperature of oil shale particles in the top portion of the bed for establishing a combustion zone at the top of the second bed; and introducing air to the top of the second bed for moving the combustion zone downwardly in the ignited second retort.

2. A process as defined in claim 3 further comprising the step of preheating the bed of unretorted oil shale particles by introducing hot flue gas from the first retort into the second retort.

3. A process as defined in claim 1 wherein the step of generating a combustible flue gas comprises:

passing gas downwardly through a bed of hot spent oil shale particles occupying a major portion of the length of the first retort.

4. A process as defined in claim 3, wherein the generating step further comprises passing the gas downwardly through a bed of unretorted oil shale particles occupying a minor portion of the length of the first retort.

5. A process for in situ retorting oil shale comprising the steps of:

introducing air into a first in situ retort containing a bed of heated oil shale particles, at least part of which bed is spent, for reaction with carbonaceous material in the heated oil shale particles and production of a combustible flue gas;

recovering flue gas from the first retort;

conducting the flue gas from the first retort to the top of a second in situ oil shale retort containing a bed of unretorted oil shale particles; and reacting the flue gas with air at a top entrance of the second retort for igniting the bed of oil shale particles therein; and wherein the steps are performed after the end of normal retorting operations when substantially all of the bed of oil shale particles in the first retort has been retorted so that the first retort is substantially completely filled with spent oil shale particles.

6. A process for retorting a bed of oil shale particles in an underground in situ retort comprising the steps of:

introducing oxygen bearing gas into a first in situ retort containing a bed of oil shale particles, at least part of which bed is spent oil shale particles, for reaction with residual carbonaceous material in the spent oil shale particles for generating a combustible off gas;

recovering combustible off gas from the first retort;

conducting the combustible off gas from the first retort to the top of bed of unretorted oil shale particles in a second in situ oil shale retort;

reacting the off gas with oxygen bearing gas at the top of the bed in the second retort for heating a portion of the top of the bed of oil shale particles therein so the ignition temperature of the oil shale particles at the top of the bed for establishing a combustion zone at the top of the bed; and introducing an oxygen bearing gas downwardly into the combustion zone for moving the combustion zone downwardly through the bed for retorting the bed of oil shale particles in the second retort.

7. A process as defined in claim 6 wherein the recovering step comprises recovering hot combustible flue gas from the first retort; and the conducting step comprises conducting the hot flue gas from the first retort to the top of the second retort for reaction with air for utilizing both the sensible heat and the latent chemical heat of the flue gas.

8. A process as defined in claim 6 further comprising the steps of:

recovering hot flue gas from the first retort;

conducting the hot flue gas to the top of the second retort; and introducing the hot flue gas downwardly into the second retort for preheating the bed of oil shale particles therein.

9. A process as defined in claim 6 wherein the combustible off gas is recovered from the first retort after the end of normal retorting operations in the first bed when substantially all of the shale oil has been retorted from the bed of oil shale particles in the first retort so that it is substantially completely filled with spent oil shale particles.

10. A process as defined in claim 6 wherein the combustible off gas is recovered from the first retort prior to the end of normal retorting operations in the first retort so that a major portion of the first retort is occupied by a bed of spent oil shale particles and a minor portion of the first retort is occupied by unretorted oil shale particles or oil shale particles undergoing retorting.

11. A process as defined in claim 6 wherein the combustible off gas recovered from said first retort is hot and said hot off gas is conducted to the top of the bed in the second retort for supplying heat to the top of the bed in the second retort.

12. A process for retorting of oil shale in an in situ retort in an underground deposit containing oil shale, said in situ oil shale retort containing a bed of oil shale particles comprising the steps of:

introducing oxygen bearing gas into a first in situ retort containing a bed of oil shale particles for moving a combustion zone and a retorting zone downwardly therethrough, thereby retorting oil shale, and continuing the retorting until the combustion zone is near the bottom of the retort, whereby the first in situ retort contains a bed of heated spent oil shale particles;

recovering combustible off gas from the bottom of the first retort after the combustion zone nears the bottom;

conducting the off gas from the bottom of the first retort to the top of a second in situ oil shale retort containing a bed of unretorted oil shale particles;

burning the off gas with air at a top entrance of the second retort for igniting the bed of oil shale particles and establishing a combustion zone therein; and introducing oxygen bearing gas into the top of the second in situ retort for moving the combustion zone downwardly through the second retort for sustaining a retorting zone below the combustion zone and retorting oil shale.

13. A process as defined in claim 12 wherein the step of recovering combustible flue gas includes:

introducing oxygen bearing gas at the top of the first retort for reaction with carbonaceous material in the heated spent shale.

* * * * *

UNITED STATES PATENT AND TRADEMARK OFFICE

CERTIFICATE OF CORRECTION

PATENT NO. : 4,005,752

DATED : February 1, 1977

INVENTOR(S) : Chang Yul Cha

It is certified that error appears in the above-identified patent and that said Letters Patent are hereby corrected as shown below:

Column 5, Claim 2, Line 33, - "3" should be -- 1 --.

Column 5, Claim 4, Line 43, - after "passing" and before "gas" delete "the".

Column 6, Claim 6, Line 9, - after "of" and before "bed" insert -- a --.

Column 6, Claim 7, Lines 22, 24 and 27 - delete "flue" after "combustible" and before "gas" and insert -- off --.

Column 6, Claim 8, Lines 30, 31 and 33,- delete "flue" after "hot" and before "gas" and insert -- off --.

Column 6, Claim 9, Lines 40 and 41, - delete "so that it is substantially completely filled with" after "retort" and before "spent" and insert -- to form --.

Signed and Sealed this

Third Day of May 1977

[SEAL]

*Attest:*

RUTH C. MASON
*Attesting Officer*

C. MARSHALL DANN
*Commissioner of Patents and Trademarks*